US008679322B2

(12) United States Patent
Marzin et al.

(10) Patent No.: US 8,679,322 B2
(45) **Date of Patent: *Mar. 25, 2014**

(54) HYDROCONVERSION PROCESS FOR HEAVY AND EXTRA HEAVY OILS AND RESIDUALS

(75) Inventors: Roger Marzin, San Antonio de Los Altos (VE); Bruno Solari, Los Teques (VE); Luis Zacarias, San Antonio de Los Altos (VE)

(73) Assignee: Intevep, S.A., Caracas (VE)

( * ) Notice: Subject to any disclaimer, the term of this patent is extended or adjusted under 35 U.S.C. 154(b) by 0 days.

This patent is subject to a terminal disclaimer.

(21) Appl. No.: 12/691,205

(22) Filed: Jan. 21, 2010

(65) Prior Publication Data

US 2011/0120908 A1 May 26, 2011

Related U.S. Application Data

(60) Provisional application No. 61/264,075, filed on Nov. 24, 2009.

(51) Int. Cl.
*C10G 47/00* (2006.01)
*C10G 47/02* (2006.01)

(52) U.S. Cl.
USPC ..... 208/108; 208/112; 208/143; 208/149

(58) Field of Classification Search
USPC ..... 208/14
See application file for complete search history.

(56) References Cited

U.S. PATENT DOCUMENTS

| | | | | |
|---|---|---|---|---|
| 3,562,150 | A | | 2/1971 | Hamilton et al. |
| 3,763,303 | A | | 10/1973 | Khuri et al. |
| 3,773,890 | A | | 11/1973 | Fox et al. |
| 4,015,977 | A | | 4/1977 | Crawford |
| 4,145,397 | A | | 3/1979 | Toida et al. |
| 4,376,695 | A | | 3/1983 | Belinko et al. |
| 4,382,068 | A | | 5/1983 | Rokukawa |
| 4,548,700 | A | | 10/1985 | Bearden, Jr. et al. |
| 4,600,504 | A | | 7/1986 | Kukes et al. |
| 4,666,685 | A | | 5/1987 | Wiewiorowski |
| 4,668,483 | A | | 5/1987 | Ladd et al. |
| 4,851,107 | A | | 7/1989 | Kretschmar et al. |
| 4,863,887 | A | * | 9/1989 | Ohtake et al. ..... 502/150 |
| 4,888,104 | A | | 12/1989 | Ramirez de Aqudelo et al. |

(Continued)

FOREIGN PATENT DOCUMENTS

| | | |
|---|---|---|
| CN | 1 335 363 | 2/2002 |
| EP | 0 271 337 | 6/1988 |
| JP | 63270542 | 11/1988 |

OTHER PUBLICATIONS

European Search Report dated May 3, 2012.

(Continued)

*Primary Examiner* — Ellen McAvoy
(74) *Attorney, Agent, or Firm* — Bachman & LaPointe, P. C.

(57) ABSTRACT

A hydroconversion process includes feeding a heavy feedstock containing vanadium and/or nickel, a catalyst emulsion containing at least one group 8-10 metal and at least one group 6 metal, hydrogen and an organic additive to a hydroconversion zone under hydroconversion conditions to produce an upgraded hydrocarbon product and a solid carbonaceous material containing the group 8-10 metal, the group 6 metal, and the vanadium and/or nickel.

27 Claims, 2 Drawing Sheets

(56) References Cited

U.S. PATENT DOCUMENTS

| | | | | |
|---|---|---|---|---|
| 4,969,988 | A | 11/1990 | Jain et al. | |
| 5,087,596 | A | 2/1992 | Clark et al. | |
| 5,124,024 | A | 6/1992 | Krzywicki et al. | |
| 2007/0025899 | A1 | 2/2007 | Marcantonio | |
| 2007/0045156 | A1 | 3/2007 | Khadzhiev et al. | |
| 2009/0023965 | A1 | 1/2009 | Pereira et al. | |
| 2009/0127161 | A1* | 5/2009 | Haizmann et al. | 208/59 |
| 2009/0129998 | A1* | 5/2009 | Haizmann et al. | 422/190 |
| 2009/0283447 | A1 | 11/2009 | D'Elia et al. | |
| 2010/0212893 | A1* | 8/2010 | Moini Araghi et al. | 166/272.1 |
| 2010/0213103 | A1* | 8/2010 | Patron et al. | 208/143 |
| 2010/0326882 | A1* | 12/2010 | McGehee et al. | 208/22 |
| 2010/0326887 | A1* | 12/2010 | McGehee et al. | 208/107 |
| 2011/0174690 | A1* | 7/2011 | Canelon et al. | 208/112 |
| 2011/0176978 | A1* | 7/2011 | Canelon et al. | 423/22 |

OTHER PUBLICATIONS

Dong et al., "Development of Residue Slurry Bed Hydrocracking Catalysts", Industrial Catalysts, vol. 12, No. 9, pp. 9-12, dated Sep. 30, 2004.

Chinese Office action dated Jan. 14, 2013.

Japanese Office action dated Dec. 18, 2012.

Chinese Office action issued Jul. 15, 2013.

* cited by examiner

HYDROCONVERSION PROCESS FOR HEAVY AND EXTRA HEAVY OILS AND RESIDUALS

BACKGROUND OF THE INVENTION

The invention relates to a catalytic process for hydroconversion and, more particularly, to a process and additive for such a process.

Hydroconversion processes in general are known, and one example of such a process is that disclosed in co-pending and commonly owned U.S. patent application Ser. No. 12/113,305, filed May 1, 2008. In the process disclosed therein, catalysts are provided in aqueous or other solutions, one or more emulsions of the catalyst (aqueous solution) in oil are prepared in advance and the emulsions are then mixed with the feedstock, with the mixture being exposed to hydroconversion conditions.

The disclosed process is generally effective at the desired conversion. It is noted, however, that the catalysts used are potentially expensive. It would be beneficial to find a way to recover this catalyst for re-use.

In addition, foaming and the like in hydroconversion reactors can create numerous undesirable consequences, and it would be desirable to provide a solution to such problems.

Hydroconversion processes in general for heavy residues, with high metal, sulfur and asphaltene contents, cannot reach high conversions (more than 80 wt %) without recycle and high catalyst concentration.

SUMMARY OF THE INVENTION

In accordance with the invention, a catalytic hydroconversion process and additive are provided wherein the additive scavenges catalyst metals and also metals from the feedstock and concentrates them in a heavy stream or unconverted residue material which exits the process reactor, and this heavy stream can be treated to recover the metals. The stream can be processed into flake-like materials. These flakes can then be further processed to recover the catalyst metals and other metals in the flakes which originated in the feedstock. This advantageously allows the metals to be used again in the process, or to be otherwise advantageously disposed of.

According to the invention, a hydroconversion process is provided which comprises the steps of feeding a heavy feedstock containing vanadium and/or nickel, a catalyst emulsion containing at least on group 8-10 metal and at least one group 6 metal, hydrogen and an organic additive to a hydroconversion zone under hydroconversion conditions to produce an upgraded hydrocarbon product and a solid carbonaceous material containing said group 8-10 metal, said group 6 metal, and said vanadium.

Further, the additive can be use to control and improve the overall fluid-dynamics in the reactor. This is due to an anti-foaming effect created by use of the additive in the reactor, and such foam control can provide better temperature control in the process as well.

The additive is preferably an organic additive, and may preferably be selected from the group consisting of coke, carbon blacks, activated coke, soot and combinations thereof. Preferred sources of the coke include but are not limited to coke from hard coals, and coke produced from hydrogenation or carbon rejection of virgin residues and the like.

The additive can advantageously be used in a process for liquid phase hydroconversion of feedstocks such as heavy fractions having an initial boiling point around 500° C., one typical example of which is a vacuum residue.

In the process, the feedstock is contacted in the reaction zone with hydrogen, one or more ultradispersed catalysts, a sulfur agent and the organic additive. While the present additive would be suitable in other applications, one preferred process is carried out in an upflow co-current three-phase bubble column reactor. In this setting, the organic additive can be introduced to the process in an amount between about 0.5 and about 5.0 wt % with respect to the feedstock, and preferably having a particle size of between about 0.1 and about 2,000 μm.

Carrying out the process as described herein using the organic additive of the invention, the organic additive scavenges catalyst metals from the process, for example including nickel and molybdenum catalyst metals, and also scavenges metals from the feedstock, one typical example of which is vanadium. Thus, the product of the process includes a significantly upgraded hydrocarbon product, and unconverted residues containing the metals. These unconverted residues can be processed into solids, for example into flake-like materials, containing heavy hydrocarbon, the organic additive, and concentrated catalyst and feedstock metals. These flakes are a valuable source of metals for recovery as discussed above.

BRIEF DESCRIPTION OF THE DRAWINGS

A detailed description of preferred embodiments of the invention follows, with reference to the attached drawing, wherein.

DETAILED DESCRIPTION

The invention relates to a process and additive for catalytic hydroconversion of a heavy feedstock. The additive acts as a scavenger of catalyst and feedstock metals, and concentrates them in a residual phase for later extraction. Further, the additive serves as a foam controlling agent, and can be used to improve overall process conditions.

Figure 1:
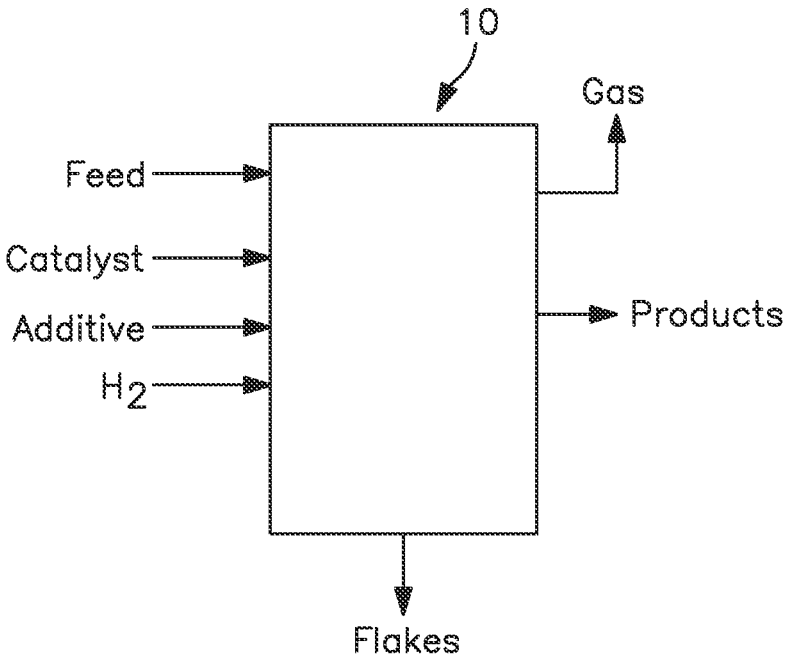
FIG. 1 schematically illustrates a process according to the invention.

FIG. 1 shows a hydroconversion unit 10 to which are fed the feedstock, catalyst preferably in an ultradispersed form, an organic additive, sulfur agent and hydrogen. Within unit 10, conversion of the feedstock occurs, and the outflows from unit 10 include a product stream including an upgraded hydrocarbon phase which can be separated into liquid and gas phases for further treatment and/or feeding to a gas recovery unit as desired, and residue which can be solidified into flakes of the spent organic additive material with scavenged catalyst and feedstock metals.

The feedstock can be any heavy hydrocarbon, and one particularly good feedstock is vacuum residue which can have properties as set forth in Table 1 below:

TABLE 1

| Properties | Unit | |
|---|---|---|
| Distillation LV % | | |
| ASTM D1160 | | |
| IBP | ° F. | 600-900 |
| Viscosity@210° F. | cst | <80000 |
| API | — | 1-7 |
| Sulfur | wt % | 3-8 |
| Nitrogen | wt % | <2 |
| Asphaltenes | wt % | 15-30 |

TABLE 1-continued

| Properties | Unit | |
|---|---|---|
| Conradson Carbon | wt % | 15-30 |
| Metal (V + Ni) | wtppm | 200-2000 |

Alternative feeds include but are not limited to feeds derived from tar sands and/or bitumen.

For a vacuum residue (VR) feedstock, this can come from a vacuum distillation unit (VDU) for example, or any other suitable source. Other similar feeds can be used, especially if they are of a type that can be usefully upgraded through hydroconversion and contain feedstock metals such as vanadium and/or nickel.

Figure 2:
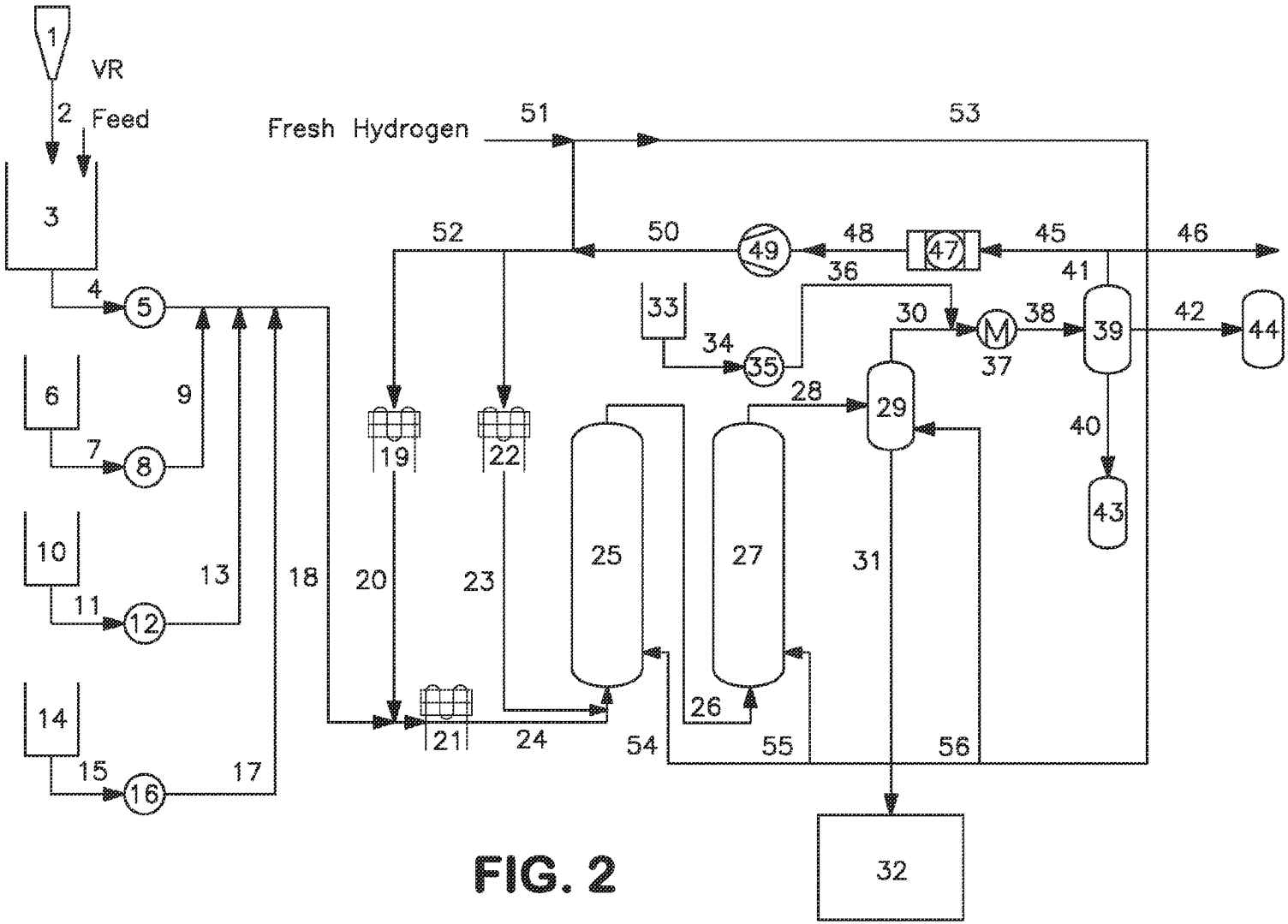
FIG. 2 shows a more detailed schematic illustration of a system for carrying out the process in accordance with the present invention.

As shows in FIG. 2, advantageously, the feedstock can be fed directly to the reactors 25, 27 without any pretreatment other than mixing with the desired emulsions and other reactant streams.

As indicated above, the additive is preferably an organic additive such as coke, carbon black, activated coke, soot, and combinations thereof. These materials can be obtained from any of numerous sources, and are readily available at very low cost. The organic additive can preferably have a particle size of between about 0.1 and about 2,000 μm.

The catalysts used are preferably a metal phase as disclosed in co-pending U.S. Ser. No. 12/113,305. The metal phase advantageously is provided as one metal selected from groups 8, 9 or 10 of the periodic table of elements, and another metal selected from group 6 of the periodic table of elements. These metals can also be referred to as group VIA and VIIIA metals, or group VIB and group VIIIB metals under earlier versions of the periodic table.

The metals of each class are advantageously prepared into different emulsions, and these emulsions are useful as feed, separate or together, to a reaction zone with a feedstock where the increased temperature serves to decompose the emulsions and create a catalyst phase which is dispersed through the feedstock as desired. While these metals can be provided in a single emulsion or in different emulsions, both well within the scope of the present invention, it is particularly preferred to provide them in separate or different emulsions.

The group 8-10 metal(s) can advantageously be nickel, cobalt, iron and combinations thereof, while the group 6 metal can advantageously be molybdenum, tungsten and combinations thereof. One particularly preferred combination of metals is nickel and molybdenum.

The method for preparing this emulsion is discussed below. The end result can be a single water-oil emulsion where the water droplets contain both the group 6 and group 8, 9 or 10 metals. Alternatively, two separate emulsions can be prepared and fed to a hydroconversion process, wherein each emulsion contains one of the metallic phases. Either of these systems is considered to fall within the broad scope of the present invention.

It is also within the scope of the invention to utilize more than the two mentioned metals. For example, two or more metals from group 8, 9 or 10 can be included in the catalyst phases of the emulsions.

In further accordance with the invention, it has been found that the catalyst phase is particularly effective when the group 6 metal is provided in the form of a sulfide metal salt. When decomposed during the hydroconversion process, these sulfides form sulfide metal particles which are advantageous in the subsequent hydroconversion processes.

The catalyst emulsion(s) and heavy feedstock can be fed to the reactors preferably in amounts sufficient to provide a ratio of catalyst metals to heavy feedstock, by weight, of between about 50 and about 1,000 wtppm.

Hydrogen can be fed to the process from any suitable source.

The reaction conditions can be as set forth in Table 2 below:

TABLE 2

| | |
|---|---|
| Reactor Pressure | 130-210 barg |
| Reactor Temperature | 430-470° C. |
| Conversion Rate | 80% or more |

Typical yield from a specified feedstock is set forth in Table 3 below:

TABLE 3

| | Weight |
|---|---|
| Feed Stock | |
| Vacuum Residue | 100 |
| Catalyst Emulsions + Coke Additive | 8-10 |
| Flushing Oil (HGO) | 2.6-3.6 |
| Hydrogen | 1.8-3 |
| Feed Total | 112.4-116.6 |
| Products | |
| $C_1$-$C_4$ | 7-9 |
| $H_2O$ | 1-2 |
| $H_2S + NH_3$ | 3.4-4.0 |
| Naphtha | 16-20 |
| Middle Distillates | 28-34 |
| VGO | 40-45 |
| Total Products (excl. Flakes) | 95.4-114 |
| Unconverted Residue or Flakes | 17-9 |

In a slurry feed process according to the invention, the unit 10 receives a vacuum residue (VR). The additive particles can be added to the VR and agitated. The agitated slurry is preferably pumped up to an elevated pressure, preferably over 200 barg, by high-pressure slurry pumps. The slurry is also heated to an elevated temperature, preferably over 400° C. Upstream, catalyst emulsions, sulfur agent and hydrogen are injected unto the slurry feed. After a slurry furnace for heating the slurry, more hydrogen can be added if needed.

The total mixture of VR, organic additive, catalyst emulsions, sulfur agent and hydrogen are introduced into the reactor and deeply hydroconverted into the desired lighter materials. Most of the hydroconverted materials are separated as vapor in a High Pressure High Temperature separator, and the vapor can be sent to a later unit for hydrotreating and further hydrocracking as needed. The vacuum gas oil (VGO) produced can also be fed to a later reactor, as desired.

In the meantime, the bottom product of the separator, in the form of a heavy slurry liquid, can be sent to a vacuum distillation unit to recover, under vacuum, any remaining lighter materials, and the final remaining bottom residue which is the unconverted residue could be sent to different type of processes where it can be converted into a solid material. One of these units could be a flaker unit wherein the bottom residue can be solidified. These resulting flakes can advantageously have the following composition:

TABLE 4

| | |
|---|---|
| Physical state and appearance | Solid brittle |
| API | −5-(−14.4) |
| Color | Brilliant Black |
| Volatility | Negligible at room temperature |
| Boiling Point | Greater than 500° C. |
| Density at 15° C. (kg/m$^3$) | 900-1350 |
| Toluene Insoluble wt % | 15-40 |
| Asphaltenes (IP-143) wt % | 30-50 preferably 30-40 |
| Heptane Insoluble (wt %) | 28-50 |
| Carbon Residue (Micron Method) wt % | 22-55 |
| Molybdenum wtppm | 1500-5000 |
| Vanadium wtppm | 1400-6500 |
| Nickel wtppm | 50-3000 |
| Carbon Content wt % | 85-93 |
| Hydrogen Content wt % | 5-9 |
| Ratio Carbon/Hydrogen | 10-17 |
| Total Nitrogen wt % | 1.-2.5 |
| Sulfur wt % | 2.2-2.7 |
| VGO (%) | 6-14 |
| Ash wt % | 0.2-2.0 |
| Volatile Matter wt %: 61.4 | 60-80 |
| Heating Value BTU/Lb | 15700-16500 |
| Moisture wt %: | 0-8.00 |
| Hardness index (HGI) | 50-68 |
| Softening Point ° C.: | 110-175 |
| Kinematic Viscosity at 275° F. cSt | 13,000-15,500 |
| Flash Point ° C. | 300-310 |
| Pour Point ° C. | 127 |

| Simulated distillation (D-7169) | % OFF (wt %) | T (° C.) |
|---|---|---|
| | IBP | 442.9 |
| | 1 | 445.6 |
| | 5 | 490.7 |
| | 10 | 510.9 |
| | 15 | 527.0 |
| | 20 | 541.9 |
| | 25 | 557.7 |
| | 30 | 574.9 |
| | 40 | 618.9 |
| | 50 | 668.5 |
| | 58 | 715.0 |

These flakes, containing remaining organic additive and also the catalyst metals and metal from the feedstock which is scavenged by the additive according to the process of the present invention, can themselves be provided to consumers as a source of useful metals, or can be used as fuel, or can be treated for extraction of the metals for re-use as process catalyst and the like. The metals can be removed from the flakes for example using combustion or thermal oxidation to convert the flakes into ash which concentrates the metals and removes any remaining hydrocarbons, or by using a desolidification procedure with solvent to isolate the solid containing the metals.

Of course, the metals to be recovered include not only the catalyst metals used in the process, but also certain metals such as vanadium which are native to the feedstock. One preferred way to recover all these metals is in a staged process wherein each stage conducts the separation of metal and uses carbon filtration units that allow the recovery of very fine particles.

FIG. 2 shows a more detailed system for carrying out the process of the present invention. As shown, the system has a hydroconversion section having one or more reactors, in this case two reactors 25 and 27, which will be discussed below.

The hydroconversion is carried out in reactors 25, 27. These reactors are connected in series, for example by line 26, and are fed with a combination of feedstock and various other reaction ingredients.

As shown to the left of reactor 25, the feed itself which is to be processed, shown as VR Feed or vacuum residue feed, is advantageously mixed with a coke additive from an additive preparation unit 1 through line 2 into mixer 3, and the resulting combination of feedstock and coke additive is passed through line 4 to a slurry pump 5 which serves to further pump the slurry of feedstock and coke additive through line 18 toward a feedstock heater 21 as shown. In addition, one or more catalyst emulsions, in this example two catalyst emulsions, are prepared as discussed above in units 10 and 14, fed through lines 11 and 15 to pumps 12 and 16, respectively, and then pumped through lines 13 and 17 into line 18 to combine with the feedstock/additive mixture, preferably at one or more points between pump 5 and heater 21.

Catalyst emulsions are shown in this schematic as being fed to the line which already contains the vacuum residue feedstock and coke additive, and the catalyst emulsions can be prepared at any catalyst emulsion preparation unit upstream of this line.

During startup of the process, a sulfur agent can be drawn from tank 6 through line 7 to pump 8 and fed through line 9 to be mixed with the other reactants in line 18. This forms the activated species as desired. The sulfur agent can preferably be recycled from $H_2S$ contained in the gas recycled from the products, and this recycled sulfur gas can be fed through various separating equipment to be discussed below, to line 50, and back to reactor 25 as desired.

Hydrogen is also fed to the reactant stream to carry out hydroconversion as desired. FIG. 2 shows Fresh Hydrogen being fed to the process through line 51 to line 52 where it is joined by recycle hydrogen and fed to preheaters 19, 22, and then lines 20, 23. The portion fed through preheater 19 and line 20, preferably 30-90% wt of the gas to be used in the process, is heated in preheater 19 to a temperature preferably between about 200° C. and about 600° C., and then mixed with the other reaction feeds prior to heater 21, and this combined mixture is fed through line 24 to reactor 25.

The second portion of the hydrogen, fed through line 23, is fed after the heater 21.

The combination of additive, feedstock, catalyst emulsions and hydrogen is then passed through heater 21 to raise the temperature of the fluids as desired, and then such fluids are passed to reactors 25 and 27, where they are exposed to hydroconversion conditions. The product stream from reactors 25, 27 is fed through line 28 to an HPHT (High Pressure High Temperature) separator 29, where the light products are separated from the heavy product, which contains the unconverted liquid, the organic additive and the used catalyst. The liquid and heavy phase separated from HPHT separator 29 is passed to a recovery metal section 32 which could include a vacuum flash tower. In this stage materials can then be fed to a solidification unit.

Hydrogen is also shown being added to the reactant stream, in this instance in two locations. One location of hydrogen addition is just prior to the feed heater 21, and the other point of introduction of additional hydrogen is after the feed heater 21. All the hydrogen feed is provided from recycled hydrogen and make-up hydrogen as shown in FIG. 2. As shown, at least a portion of the hydrogen goes to the preheater 19 prior to being fed to the heater 24 and the other portion goes to the preheater 22.

Reactors 25, 27 can advantageously be tubular reactors, vertically spaced, with or without internals, preferably without, where the liquid, solid and gas go upstream. This is the area where conversion takes place, under average temperatures between 250 and 500° C., preferably between 400 and 490° C., at a hydrogen partial pressure between 50 and 300 bar, and a gas/liquid ratio of between 100 and 15,000 Nm$^3$/T.

It should be noted that in separators 29, 39, products from line 28 exiting reactor 27 are separated, and light products are separated from the heavy products. The heavy products contain the non-converted liquid, the organic additive and the used catalyst.

The heavy product is fed through line 31 to the metal recovery section 32. In this section, HHGO (heavy hydroconverted gasoil) is separated from the non-converted residue and organic additive using a vacuum residue tower or the like. The HHGO can be used in emulsion preparation, and the mixture of residue, non-converted liquid and organic additive can be cooled and sold as flakes. The metals can be extracted from the non-converted liquid and the organic additive, or could be extracted from the flakes.

The hot separator bottoms can have various uses, several non-limiting examples of which will be discussed below.

For the metal extraction process, the feed selected (flakes or bottom of vacuum distillation tower) is converted into a form from which the metals can be recovered. The recovery of the metals should be carried out in a two-stage process. The first stage comprises a pyrolysis or thermal oxidation either at low or high temperatures to remove the tars, and the second stage comprises an acid or basic lixiviation.

The light products in line 30 from separator 29 are mixed with wash water from tank 33, which water is fed through line 34 and pump 35 to line 36 and into line 30. This mixture is cooled in heat exchanger 37 and these products are then sent through line 38 to the second separator 39.

There are three streams 40, 41, 42 coming out from the second separator 39. The first stream 40 comprises the sour water, the second stream 41 is the process gas (C1-4, $H_2S$, $NH_3$, $H_2$, C5+) that goes to recycle line 45 and to the purge section 46, and the third stream 42 contains the liquid products.

The recycle gas 45 passes through a filter 47 to remove impurities and then is compressed 49 and mixed with fresh hydrogen 51. This mixture goes in a proportion, between 10/90 to 50/50 (fresh hydrogen/recycle gas), to the gas preheaters (19, 22).

It should also be noted that fresh hydrogen can be fed through line 53 to lines 54, 55 and 56 to supply hydrogen gas at these various points of need in reactors 25, 27 and separator 29.

EXAMPLE 1

Following the scheme represented in FIG. 2, the following experiment was conducted.

A heavy feedstock comprised by a conventional vacuum residue (VR) of Venezuelan oil, Petrozuata, was fed into a reactor with a total capacity of 10 BPD. Said reactor was a slurry bubble column reactor without any internals, with a temperature control based on a preheater system and cool gas injection. This reactor has a length of 1.6 m and a diameter of 12 cm.

This reactor was operated at 0.52 T/m$^3$h (spatial velocity) at a total pressure of 170 barg, a gas to liquid ratio ($H_2$/liquid) of 32990 scf/bbl, a gas velocity of 5.98 cm/s. An organic additive was added to the feedstock in a concentration of 1.5 wt % and with a particle size ranging 200-300 μm. At these conditions, an ultradispersed catalyst was injected to the process to obtain 92 wtppm of nickel and 350 wtppm of molybdenum sulfide inside the reactor.

The average temperature inside the reactor was 458° C. The average residue conversion reached at these conditions was 94.3 wt % and the asphaltene conversion was 89.2 wt %.

The residue 500° C.$^+$ (R) conversion is estimated as follows:

$$X^{+}_{500^\circ\,C.} = \frac{R_{in} - R_{out}}{R_{in}} \times 100$$

The process described in this example was carried out in a continuous operation for 21 days. Three serially connected vertical slurry reactors were used during this test.

This example is summarized in the following table:

| Feedstock characteristics | |
|---|---|
| API density (60° F.) | 2.7 |
| Residue 500° C.$^+$ (wt %) | 90.95 |
| Asphaltenes (IP-143) (wt %) | 18.7 |
| Metal content (V + Ni) (wtppm) | 959 |
| Sulfur (wt %) | 3.10 |
| **Process variables** | |
| WSHV (T/m$^3$h) | 0.52 |
| Feedrate (kg/h) | 30 |
| Total pressure (barg) | 170 |
| Reactor average temperature (° C.) | 458 |
| Gas/Liquid ratio (scf/bbl) | 32990 |
| Gas superficial velocity (inlet first reactor) (cm/s) | 5.98 |
| Particle size (μm) | 200-300 |
| Organic additive concentration (wt %) | 1.5 |
| Nickel catalyst concentration (wtppm) | 92 |
| Molybdenum catalyst concentration (wtppm) | 350 |
| **Conversions** | |
| $X_{500^\circ\,C.}^{+}$ (wt %) | 94.3 |
| $X_{asphaltene}$ (wt %) | 89.2 |
| $X_{microcarbon}$ (wt %) | 86.5 |
| $X_{asphaltene}/X_{500^\circ\,C.}^{+}$ | 0.9 |
| **Other Parameters** | |
| HDS (wt %) | 69.7 |
| HDN (wt %) | 15.7 |
| HDO (wt %) | 35.0 |
| HDNi (wt %) | 98.4 |
| HDV (wt %) | 99.7 |
| HDMo (wt %) | 99.6 |
| **Products** | |
| Naptha (IBP-200° C.) (wt %) | 18.2 |
| Middle distillates (200-343° C.) (wt %) | 31.6 |
| VGO (343-500° C.) (wt %) | 33.6 |
| Liquid products (wt %) | 83.4 |
| $C_1$-$C_4$ (wt %) | 7.3 |

EXAMPLE 2

Following the scheme represented in FIG. 2, the following experimentation was effected.

The test was carried out using a sample of vacuum residue (VR) of Canadian oil, prepared from Athabasca crude.

This VR was fed into a pilot plant with a total capacity of 10 BPD, with the same slurry bubble column reactor without any internals, as used in example 1, with a temperature control based on a preheater system and cool gas injection.

For this test the reactor was operated at two different spatial velocities of 0.42 and 0.73 T/m$^3$h. Three serially connected vertical slurry reactors were used during this test. The plant was in continuous operation during 20 days.

At 0.42 T/m$^3$h conditions were: total pressure of 169 barg, gas to liquid ratio ($H_2$/liquid) of 34098 scf/bbl, gas velocity of 7.48 cm/s, an organic additive concentration of 1.5 wt % with a particle size ranging 200-300 μm, with an injection of an ultradispersed catalyst to reach 92 wtppm of nickel and 350 wtppm of molybdenum inside the reactor. These conditions were maintained for 11 days.

The average temperature inside the reactor was 453° C. The average residue conversion reached at these conditions was 91.9 wt % and the asphaltene conversion was 93.6 wt %.

The results for these conditions are summarized in the following table:

| Feedstock characteristics | |
|---|---|
| API density (60° F.) | 2.04 |
| Residue 500° C.$^+$ (wt %) | 97.60 |
| Asphaltenes (insolubles in heptane) (wt %) | 21.63 |
| Metal content (V + Ni) (wtppm) | 462 |
| Sulfur (wt %) | 6.56 |
| **Process variables** | |
| WSHV (T/m$^3$h) | 0.42 |
| Feedrate (kg/h) | 24 |
| Total pressure (barg) | 169 |
| Reactor average temperature (° C.) | 453 |
| Gas/Liquid ratio (scf/bbl) | 34098 |
| Gas superficial velocity (inlet first reactor) (cm/s) | 7.48 |
| Particle size (μm) | 200-300 |
| Organic additive concentration (wt %) | 1.5 |
| Nickel catalyst concentration (wtppm) | 92 |
| Molybdenum catalyst concentration (wtppm) | 350 |
| **Conversions** | |
| $X_{500° C.}^+$ (wt %) | 91.92 |
| $X_{asphaltene}$ (wt %) | 93.6 |
| $X_{microcarbon}$ (wt %) | 89.36 |
| $X_{asphaltene}/X_{500° C.}^+$ | 1.0 |
| **Other Parameters** | |
| HDS (wt %) | 77.1 |
| HDN (wt %) | 7.9 |
| HDO (wt %) | 40.6 |
| HDNi (wt %) | 99.3 |
| HDV (wt %) | 99.9 |
| HDMo (wt %) | 100.0 |

At 0.73 T/m$^3$h conditions were: total pressure of 169 barg, gas to liquid ratio ($H_2$/liquid) of 19818 scf/bbl, gas velocity of 7.57 cm/s, an organic additive concentration of 1.5 wt % with a particle size ranging 200-300 μm, with an injection of an ultradispersed catalyst to reach 92 wtppm of nickel and 350 wtppm of molybdenum inside the reactor.

The average temperature inside the reactor was 462° C. The average residue conversion reached at these conditions was 91.2 wt % and the asphaltene conversion was 83.7 wt %. This conditions was maintained for 6 days.

The results for these conditions is summarized in the following table:

| Feedstock characteristics | |
|---|---|
| API density (60° F.) | 2.04 |
| Residue 500° C.$^+$ (wt %) | 97.60 |
| Asphaltenes (insolubles in heptane) (wt %) | 21.63 |
| Metal content (V + Ni) (wtppm) | 462 |
| Sulfur (wt %) | 6.56 |
| **Process variables** | |
| WSHV (T/m$^3$h) | 0.73 |
| Feedrate (kg/h) | 42 |
| Total pressure (barg) | 169 |
| Reactor average temperature (° C.) | 462 |
| Gas/Liquid ratio (scf/bbl) | 19818 |
| Gas superficial velocity (inlet first reactor) (cm/s) | 7.57 |
| Particle size (μm) | 200-300 |
| Organic additive concentration (wt %) | 1.5 |
| Nickel catalyst concentration (wtppm) | 92 |
| Molybdenum catalyst concentration (wtppm) | 350 |
| **Conversions** | |
| $X_{500° C.}^+$ (wt %) | 91.21 |
| $X_{asphaltene}$ (wt %) | 83.72 |
| $X_{microcarbon}$ (wt %) | 84.30 |
| $X_{asphaltene}/X_{500° C.}^+$ | 0.9 |
| **Other Parameters** | |
| HDS (wt %) | 75.01 |
| HDN (wt %) | 11.32 |
| HDO (wt %) | 41.83 |
| HDNi (wt %) | 98.87 |
| HDV (wt %) | 99.84 |
| HDMo (wt %) | 100.0 |

EXAMPLE 3

Following the scheme represented in FIG. 2, the following experimentation was effected.

This third test was carried out using a mixture of vacuum residue (VR) of Venezuelan oils, comprising Merey, Santa Barbara, Anaco Wax and Mesa.

This VR was fed into a pilot plant with a total capacity of 10 BPD, with the same slurry bubble column reactor without any internals of example 1, with a temperature control based on a preheater system and cool gas injection.

For this test the reactor was operated at two different spatial velocities of 0.4 and 0.5 T/m$^3$h, changing the catalyst and the solid concentration. Three serially connected vertical slurry reactors were used during this test. The plant was in continuous operation for 39 days.

At 0.4 T/m$^3$h spatial velocity, solids, catalysts and sulfur ammonium concentrations were changed, in the following table the results are summarized:

| Feedstock characteristics | | | | | |
|---|---|---|---|---|---|
| API density (60° F.) | 5.1 | | | | |
| Residue 500° C.$^+$ (wt %) | 94.83 | | | | |
| Asphaltenes (IP-143) (wt %) | 16 | | | | |
| Metal content (V + Ni) (wtppm) | 578 | | | | |
| Sulfur (wt %) | 3.2 | | | | |
| **Process variables** | | | | | |
| WSHV (T/m$^3$h) | 0.4 | | | | |
| Feedrate (kg/h) | 24 | | | | |
| Total pressure (barg) | 169 | | | | |
| Reactor average temperature (° C.) | 451 | 451 | 453 | 453 | 452 |
| Gas/Liquid ratio (scf/bbl) | 29152 | | | | |
| Gas superficial velocity (inlet first reactor) (cm/s) | 5.82 | | | | |
| Particle size (μm) | 212-850 | | | | |
| Sulfur ammonium concentration (wt %) | 0.2 | 0.2 | 0.2 | 0.2 | 4.47 |
| Organic additive concentration (wt %) | 1.5 | 2 | 2 | 2 | 2 |
| Nickel catalyst concentration (wtppm) | 100 | 100 | 118 | 132 | 132 |
| Molybdenum catalyst concentration (wtppm) | 400 | 400 | 450 | 500 | 500 |
| **Conversions** | | | | | |
| $X_{500° C.}^+$ (wt %) | 82.8 | 81.8 | 83.9 | 85.2 | 85.4 |
| $X_{asphaltene}$ (wt %) | 80.4 | 74.9 | 75.4 | 75.7 | 76.1 |

-continued

| | | | | | |
|---|---|---|---|---|---|
| $X_{microcarbon}$ (wt %) | 74.7 | 80.8 | 79.2 | 82.9 | 83.7 |
| $X_{asphaltene}/X_{500° C.}^{+}$ | 1.0 | 0.9 | 0.9 | 0.9 | 0.9 |
| Other Parameters | | | | | |
| HDS (wt %) | | | | 63.4 | |
| HDN (wt %) | | | | 40.7 | |
| HDO (wt %) | | | | 51.5 | |

The operation conditions and the results at 0.5 T/m$^3$h spatial velocity, are presented in the following table:

| Feedstock characteristics | |
|---|---|
| API density (60° F.) | 5.1 |
| Residue 500° C.$^+$ (wt %) | 94.83 |
| Asphaltenes (IP-143) (wt %) | 16 |
| Metal content (V + Ni) (wtppm) | 578 |
| Sulfur (wt %) | 3.2 |
| Process variables | |
| WSHV (T/m$^3$h) | 0.5 |
| Feedrate (kg/h) | 30 |
| Total pressure (barg) | 169 |
| Reactor average temperature (° C.) | 456 |
| Gas/Liquid ratio (scf/bbl) | 29152 |
| Gas superficial velocity (inlet first reactor) (cm/s) | — |
| Particle size (μm) | 212-850 |
| Organic additive concentration (wt %) | 1.5 |
| Nickel catalyst concentration (wtppm) | 100 |
| Molybdenum catalyst concentration (wtppm) | 400 |
| Conversions | |
| $X_{500° C.}^{+}$ (wt %) | 82.9 |
| $X_{asphaltene}$ (wt %) | 79.6 |
| $X_{microcarbon}$ (wt %) | 72.4 |
| $X_{asphaltene}/X_{500° C.}^{+}$ | 1.0 |

EXAMPLE 4

Following the scheme represented in FIG. 2, the following experiment was conducted.

This example was carried out using a vacuum residue (VR) of Venezuelan oil, Merey/Mesa.

This VR was fed into a pilot plant with a total capacity of 10 BPD, with the same slurry bubble column reactor without any internals as in example 1, with a temperature control based on a preheater system and cool gas injection.

For this test the reactor was operated at 0.4 T/m$^3$h (spatial velocity), using three serially connected vertical slurry reactors.

The reactor was operated at a total pressure of 169 barg, a gas to liquid ratio ($H_2$/liquid) of 40738 scf/bbl, a gas velocity of 6.4 cm/s.

An organic additive was added to the feedstock in a concentration of 1.5 wt % and with a particle size ranging 212-850 μm. At these conditions an ultradispersed catalyst was injected to the process to obtain 132 wtppm of nickel and 500 wtppm of molybdenum inside the reactor.

The average temperature inside the reactor was 452.1° C. The average residue conversion reached at these conditions was 80.9 wt % and the asphaltene conversion was 76.5 wt %. The plant was in continuous operation for 21 days.

This results are summarized in the following table:

| Feedstock characteristics | |
|---|---|
| API density (60° F.) | 5.0 |
| Residue 500° C.$^+$ (wt %) | 96.3 |
| Asphaltenes (IP-143) (wt %) | 19.3 |
| Metal content (V + Ni) (wtppm) | 536 |
| Sulfur (wt %) | 3.28 |
| Process variables | |
| WSHV (T/m$^3$h) | 0.4 |
| Feedrate (kg/h) | 24 |
| Total pressure (barg) | 170 |
| Reactor average temperature (° C.) | 452.1 |
| Gas/Liquid ratio (scf/bbl) | 40738 |
| Gas superficial velocity (inlet first reactor) (cm/s) | 6.4 |
| Particle size (μm) | 212-850 |
| Organic additive concentration (wt %) | 1.5 |
| Nickel catalyst concentration (wtppm) | 132 |
| Molybdenum catalyst concentration (wtppm) | 500 |
| Conversions | |
| $X_{500° C.}^{+}$ (wt %) | 80.9 |
| $X_{asphaltene}$ (wt %) | 76.5 |
| $X_{microcarbon}$ (wt %) | 75.0 |
| $X_{asphaltene}/X_{500° C.}^{+}$ | 0.9 |
| Other Parameters | |
| HDS (wt %) | 47.4 |
| HDN (wt %) | 22.7 |
| HDO (wt %) | 14.3 |
| HDV (wt %) | 98.4 |
| HDNi (wt %) | 98.6 |
| Products | |
| Naptha (IBP-200° C.) (wt %) | 13.5 |
| Middle distillates (200-343° C.) (wt %) | 22.5 |
| VGO (343-500° C.) (wt %) | 43.1 |
| Liquid products (wt %) | 79.1 |
| $C_1$-$C_4$ (wt %) | 5.4 |

The above examples demonstrate the excellent results obtained using the process according to the invention.

The present disclosure is provided in terms of details of a preferred embodiment. It should also be appreciated that this specific embodiment is provided for illustrative purposes, and that the embodiment described should not be construed in any way to limit the scope of the present invention, which is instead defined by the claims set forth below.

The invention claimed is:

1. A hydroconversion process, comprising feeding (a) a heavy feedstock containing at least one feedstock metal selected from the group consisting of vanadium and nickel, (b) a catalyst emulsion comprising a water-oil emulsion containing at least one group 8-10 metal and at least one group 6 metal in solution in an aqueous phase of the emulsion, (c) hydrogen and (d) an organic additive to a hydroconversion zone of an upstream bubble column reactor under hydroconversion conditions to produce an upgraded hydrocarbon product and a solid carbonaceous material containing said group 8-10 metal, said group 6 metal, and said at least one feedstock metal, wherein the organic additive which has an anti-foaming effect comprises coke particles having a particle size of between about 0.1 and about 2,000 μm wherein the organic additive, and hydrogen are added to the heavy feedstock to provide a reactant blend which is fed to a heater prior to being fed to the hydroconversion zone, wherein the coke particles scavenge metals in the reactor and thereafter the coke particles with metals are passed from the reactor to a metal recovery station.

2. The process of claim 1, wherein the heavy feedstock is selected from the group consisting of vacuum residue, heavy crude, extra heavy crude and combinations thereof.

3. The process of claim 1, wherein the heavy feedstock is vacuum residue.

4. The process of claim 1, wherein the heavy feedstock has an API gravity of between about 1 and about 7.

5. The process of claim 1, wherein the heavy feedstock has a metal content of between about 200 and about 2,000 wtppm.

6. The process of claim 5, wherein the metal content of the heavy feedstock comprises vanadium and nickel.

7. The process of claim 1, wherein the catalyst emulsion comprises a first catalyst emulsion containing the group 8-10 metal and a second catalyst emulsion containing the group 6 metal.

8. The process of claim 1, wherein the group 8-10 metal is selected from the group consisting of nickel, cobalt, iron and combinations thereof.

9. The process of claim 1, wherein the group 6 metal is selected from the group consisting of molybdenum, tungsten and combinations thereof.

10. The process of claim 1, wherein the group 6 metal is in the form of a group 6 sulfide metal salt.

11. The process of claim 1, further comprising the steps of crushing and screening a raw coke to produce raw coke particles, and thermally treating the raw coke particles to produce the coke particles for use as the organic additive.

12. The process of claim 1, wherein the process produces the upgraded hydrocarbon at a conversion rate from the heavy feedstock of at least about 80 wt %.

13. The process of claim 1, wherein the hydroconversion produces an unconverted residue containing said solid carbonaceous material, and wherein said solid carbonaceous material from said unconverted residue has a carbon content of between about 85 and about 93 wt %.

14. The process of claim 1, wherein the solid carbonaceous material is in flake form.

15. The process of claim 1, wherein the process is carried out on a continuous basis.

16. The process of claim 15, wherein the process is carried out with the feedstock on a once-through basis.

17. The process of claim 1, wherein the hydroconversion conditions comprise a reactor pressure of between about 130 and about 210 barg, and a reactor temperature of between about 430 and about 470° C.

18. The process of claim 1, wherein the catalyst emulsion and the heavy feedstock are fed to the reactor in amounts to provide a ratio of catalyst metals to heavy feedstock, by weight, of between about 50 and about 1,000 wtppm.

19. The process of claim 1, wherein product yield on a weight basis, excluding the solid carbonaceous material, is greater than weight of the heavy feedstock.

20. The process of claim 1, wherein the solid carbonaceous material is fed to a metal recovery unit to separate the group 8-10 metal, the group 6 metal and the at least one feedstock metal.

21. The process of claim 1, wherein the upgraded hydrocarbon product comprises a vapor phase and a liquid-solid phase comprising the solid carbonaceous material and unconverted residue.

22. The process of claim 21, wherein the vapor phase is fed to a sequential hydroprocessing unit for further upgrading, and wherein the liquid-solid phase is fed to a vacuum flash tower for separation of remaining lighter materials from the unconverted heavy feedstock, and the solid carbonaceous material is fed to a metal recovery unit.

23. The process of claim 1, wherein the hydroconversion zone comprises an up flow co-current three-phase bubble column reactor.

24. The process of claim 23, wherein the organic additive is added in an amount between about 0.5 and about 5.0 wt % with respect to the heavy feedstock.

25. The process of claim 23, wherein the organic additive has a particle size of between about 0.1 and about 2,000 μm.

26. The process of claim 1, wherein the feedstock is derived from at least one of tar sand, bitumen, and combinations thereof.

27. The process of claim 1, wherein the feedstock is subjected to the hydroconversion conditions without any pretreatment.

* * * * *